US006167573B1

(12) United States Patent
Lewis

(10) Patent No.: US 6,167,573 B1
(45) Date of Patent: Jan. 2, 2001

(54) SUSPENDERS

(75) Inventor: Patricia Lewis, Huber Heights, OH (US)

(73) Assignee: Morning Pride Manufacturing, L.L.C., Dayton, OH (US)

( * ) Notice: Under 35 U.S.C. 154(b), the term of this patent shall be extended for 0 days.

(21) Appl. No.: 09/406,468

(22) Filed: Sep. 27, 1999

(51) Int. Cl.[7] ..... A41F 19/00

(52) U.S. Cl. ..... 2/327; 2/327; 2/326

(58) Field of Search ..... 2/326, 327, 328, 2/329, 330, 331–333, 340, 338; 182/3, 4; 244/151 R

(56) References Cited

U.S. PATENT DOCUMENTS

| | | | | |
|---|---|---|---|---|
| Re. 34,094 | | 10/1992 | Grilliot et al. . | |
| 468,561 | * | 2/1892 | Dunham | 2/327 |
| 638,428 | | 12/1899 | Specht . | |
| 713,659 | | 11/1902 | Macwilliam . | |
| 2,030,791 | | 2/1936 | Hickok . | |
| 2,185,400 | | 1/1940 | Cohen . | |
| 4,481,682 | * | 11/1984 | Hall | 2/326 |
| 4,850,057 | | 7/1989 | Schierenbeck . | |
| 5,177,814 | * | 1/1993 | Courtney | 2/326 |
| 5,497,923 | * | 3/1996 | Pearson et al. | 224/253 |

FOREIGN PATENT DOCUMENTS 660786 7/1929 (FR) .

* cited by examiner

*Primary Examiner*—Gloria M. Hale
*Assistant Examiner*—Tejash Patel
(74) *Attorney, Agent, or Firm*—Rockey, Milnamow & Katz, Ltd.

(57) ABSTRACT

A pair of suspenders comprises two comparatively long straps of a given width. Each of the comparatively long straps has a front portion terminating at a front end and a back portion terminating at a back end. The back portions cross each other. Moreover, a comparatively short strap having two opposite ends is affixed at each of the opposite ends to the back portion of each of the comparatively long straps so as to define a loop, which has an overall length that is at least several times greater than the given width of the comparatively long straps. One of the straps defining each of the loops passes through the other loop, whereby the loops enable the pair of suspenders, over a range of shoulder-to-shoulder spacings, to conform automatically to the shoulder-to-shoulder spacing of a wearer. The comparatively long straps are substantially inelastic. Furthermore, an elastic strap is attached to the each of the front and back portions of each of the comparatively long straps and each of the elastic straps has a distal end, to which a fastener is attached for fastening the elastic strap to a pair of pants. Preferably, the fastener is a wire loop, which is shaped to coact with a button on the pair of pants. Alternatively, the fastener is a clip, which is adapted to clip onto the pair of pants.

6 Claims, 1 Drawing Sheet

SUSPENDERS

TECHNICAL FILED OF THE INVENTION

This invention pertains to improvements in a pair of suspenders, particularly but not exclusively in a pair of suspenders designed for heavy duty use, as by a firefighter, by a farmer, by a worker on an oil rig or on a building site, or by a person engaged in hunting or fishing.

BACKGROUND OF THE INVENTION

Generally, as known heretofore, a pair of suspenders designed for heavy duty use comprises two elongate straps made from a substantially inelastic material, such as leather or webbing made from natural, synthetic, or blended fibers. Each of the elongate straps has a front portion terminating at a front end and a back portion terminating at a back end.

Generally, as known heretofore, the front and back ends are adapted for fastening to a pair of pants, as via shorter elastic or inelastic straps having buttonholes adapted to coact with buttons on the pair of pants or mounting fasteners, such as wire loops adapted to coact with buttons on the pair of pants or clips adapted to clip onto the pair of pants.

Generally, as known heretofore, the back portions of the elongate straps cross each other and are attached to each other by stitching or otherwise where they cross each other. U.S. Pat. No. 4,850,057, the disclosure of which is incorporated herein by reference, discloses an arrangement wherein the back portions of the elongate straps can be pivotally attached to each other, at any selected one of multiple pivot points.

An alternative arrangement comprising one elongate, substantially inelastic strap and two shorter, elastic straps, rather than two elongate, substantially inelastic straps and shorter elastic or inelastic straps, is disclosed in U.S. Pat. No. 34,094, the disclosure of which is incorporated herein by reference.

As discussed in U.S. Pat. No. 4,850,057 and in U.S. Pat. No. 34,094, a pair of suspenders designed for heavy duty use, as by a firefighter, should fit its wearer comfortably and should not unduly hamper the mobility of the wearer, notwithstanding the size, shape, and weight of the wearer.

SUMMARY OF THE INVENTION

This invention provides improvements in a pair of suspenders, particularly but not exclusively in a pair of suspenders designed for heavy duty use, as by a firefighter, by a farmer, or by a worker on an oil rig or on a building site. As improved by this invention, the pair of suspenders can be comfortably worn to hold up a pair of pants, by a wearer having a shoulder-to-shoulder spacing within a wide range of possible spacings, without unduly limiting the mobility of the wearer.

Generally, the pair of suspenders comprises two comparatively long straps, each of which has a given width. Each of the comparatively long straps has a front portion terminating at a front end and a back portion terminating at a back end.

In a preferred embodiment, as considered in a first way, a comparatively short strap having two opposite ends is affixed at each of its opposite ends to the back portion of each of the comparatively long straps so as to define a loop, which has an overall length that is greater than the given width of the comparatively long straps, and one of the comparatively long and comparatively short straps defining each of the loops passes through the other loop.

In the preferred embodiment, as considered in a second way, each of the elongate straps has two layers at least at the back portion. Moreover, the two layers at the back portion of each of the elongate straps are separated from each other so as to define a loop, which has an overall length that is greater than the given width of the elongate straps, and one of the separated layers defining each of the loops passes through the other loop.

In an alternative embodiment, as considered in a first way, a comparatively short strap having two opposite ends is affixed at each of its opposite ends to the back portion of a given one of the comparatively long straps so as to define a loop, which has an overall length that is greater than the given width of the comparatively long straps, and the other one of the straps passes through the loop.

In the alternative embodiment, as considered in a second way, each of the elongate straps has two layers at least at the back portion. Moreover, the two layers at the back portion of at least one of the elongate straps are separated from each other so as to define a loop, which has an overall length that is greater than the given width of the elongate straps, and at least one of the layers of the other one of the elongate straps passes through the loop.

Preferably, in each of the preferred and alternative embodiments, the straps mentioned above are substantially inelastic. Preferably, moreover, an elastic strap having an upper end and a lower end is attached at the upper end to each of the front and back portions of the first-mentioned straps. A fastener, which is attached to the lower end of each of the elastic straps, the fastener being adapted for fastening to a pair of pants.

Herein, directional terms including "front", "back", "upper", and "lower" are taken from a vantage of a person wearing a pair of suspenders to hold up a pair of pants.

These and other objects, features, and advantages of this invention are evident from the following description of a preferred embodiment of this invention and of an alternative embodiment thereof, with reference to the accompanying drawings.

DETAILED DESCRIPTION OF THE ILLUSTRATED EMBODIMENTS

Figure 1:
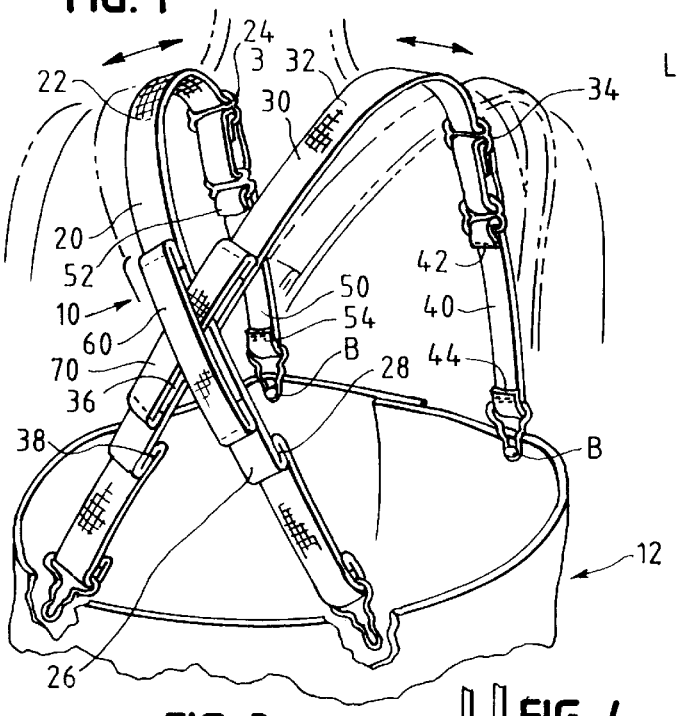
FIG. 1 is a perspective view of a pair of suspenders constituting a preferred embodiment of this invention. A pair of pants, with which the pair of suspenders is worn, is shown fragmentarily. An upper torso of a wearer having a comparatively narrow shoulder-to-shoulder spacing is shown fragmentarily in full lines. An upper torso of a wearer having a comparatively wide shoulder-to-shoulder spacing is shown fragmentarily in broken lines.
Figure 2:
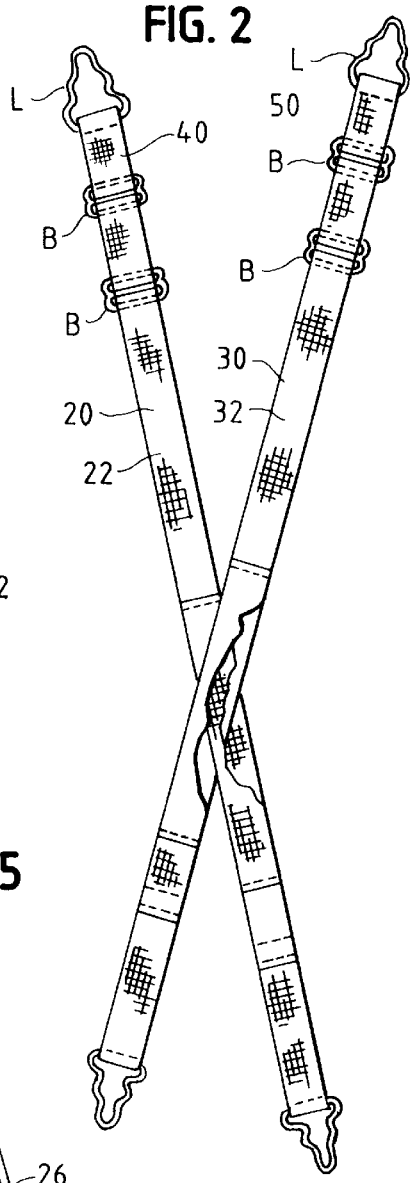
FIG. 2 is a partly broken away, plan view of the pair of suspenders, which are shown as if spread on a flat surface.
Figure 3:
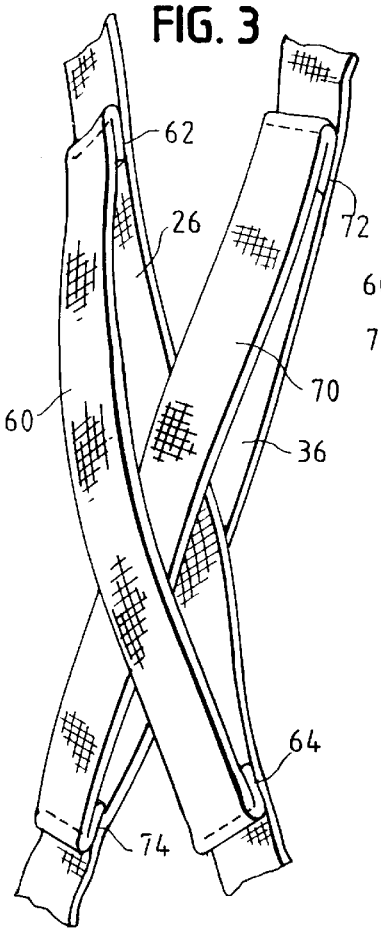
FIG. 3, on an enlarged scale, is a perspective, fragmentary detail of two loops coacting in the preferred embodiment.
Figure 4:
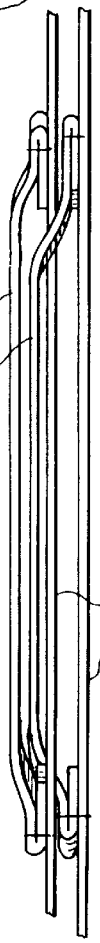
FIG. 4, on a similar scale, is a fragmentary elevation of one side of the loops, as shown in FIG. 3.

As shown in FIGS. 1, 2, and 3, a pair 10 of suspenders designed for heavy duty use, as by a firefighter, by a farmer, by a worker on an oil rig or on a building site, or by a person engaged in hunting or fishing, constitutes a preferred embodiment of this invention. As improved by this invention, the pair 10 of suspenders can be comfortably worn to hold up a pair 12 of pants, by a wearer having a shoulder-to-shoulder spacing within a wide range of possible spacings, without unduly limiting the mobility of the wearer.

The pair 10 of suspenders comprises two comparatively long straps 20, 30, each of which has a given width, e.g., 1¾ inches. The strap 20 has a front portion 22 terminating at a front end 24 and a back portion 26 terminating at a back end 28. A double-loop buckle B of a known type (see, e.g., U.S. Pat. No. 4,967,421) is provided so that the effective length of the front portion 22 can be easily adjusted in a known way. The strap 30 has a front portion 32 terminating at a front end 34 and a back portion 36 terminating at a back end 38. As similar buckle B is provided so that the effective length of the front portion 32 can be similarly adjusted.

An elastic strap 40 having a similar width, as compared to the strap 20, is attached at its upper end 42, via s similar buckle B, to the front portion 22 of the strap 20. An elastic strap 50, which is similar to the elastic strap 40, is attached at its upper end 52, via a similar buckle B, to the front portion 32 of the strap 30. A wire loop L of a known type (see, e.g., U.S. Pat. No. 4,850,057) is attached in a known way (ibid.) to the lower end of each of the elastic straps 40, 50, for coacting with a button B attached to the pair 12 of pants for fastening to the pair 12 of pants.

Similar straps and similar wire loops coacting with similar buttons are provided at the back end 28 of the strap 20 and at the back end of the strap 30. Rather than such wire loops coacting with such buttons, clips C of a known type can be alternatively provided for fastening to the pair 12 of pants.

As provided by this invention, a comparatively short strap 60 having a similar width, as compared to the straps 20, 30, is attached at its opposite ends 62, 64, to the back portion 26 of the strap 20 so as to define a loop 66 and a comparatively short strap 70 having a similar width, as compared to the straps 20, 30, is attached at its opposite ends 72, 74, to the back portion 36 of the strap 30 so as to define a loop 76.

Each of the loops 66, 76, has an overall length that is at least several times greater than the given width of the straps 20, 30, 60, 60. The overall lengths of the loops 66, 76, are measured when the pair 10 of suspenders is spread on a planar surface, as shown in FIG. 2, so that the comparatively long straps 20, 30, are substantially straight and substantially taut.

As considered in a first way, this invention provides that one of the straps 20, 60, that defines the loop 66 passes through the loop 76 and that one of the straps 30, 70, that defines the loop 76 passes through the loop 66. In a preferred arrangement, as shown in FIG. 3, the strap 20 passes through the loop 76 defined by the straps 30, 70, and the strap 70 passes through the loop 66 defined by the straps 20, 60. In an alternative arrangement (not shown) the strap 60 passes through the loop 66 and the strap 30 passes through the loop 76.

As considered in a second way, this invention provides that the straps 20, 60, constitute two layers, which are separated at the back portion 26 of the strap 20 so as to define the loop 66, and that the straps 30, 70, constitute two layers, which are separated at the back portion 36 of the strap 30 so as to define the loop 76. Moreover, as considered in the second way, this invention provides that one of the layers constituted by the straps 20, 60, passes through the loop 76 and that one of the layers constituted by the straps 30, 70, passes through the loop 76.

In an alternative arrangement (not shown) which may be also considered in the second way, the straps 20, 60, have equal lengths and are joined to each other along their complete lengths, except where separated so as to define the loop 66 and the straps 30, 70, have equal lengths and are joined to each other along their complete lengths, except where separated to define the loop 76.

Figure 5:
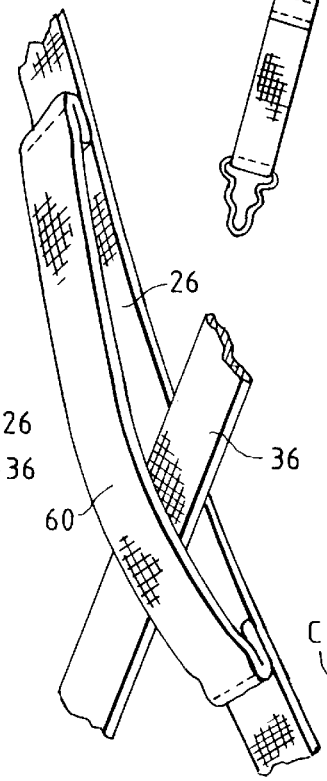
FIG. 5, on a similar scale, is a perspective, fragmentary detail of one loop and a strap passing through the loop, in an alternative embodiment of this invention.
Figure 6:
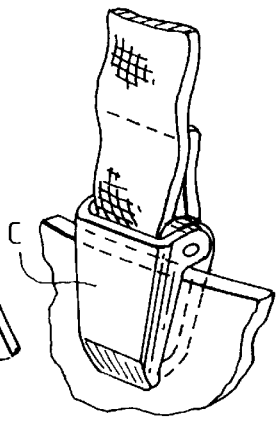
FIG. 6, on a similar scale, is a perspective, fragmentary detail of on end of a strap and a clip, which exemplifies clips that can be usefully substituted for wire loops used in the preferred embodiment for fastening the pair of suspenders to a pair of pants.

An alternative embodiment, as shown in FIG. 5, is similar to the preferred embodiment, as shown in FIGS. 1, 2, and 3 and as described above, except that the comparatively short strap 70 is omitted and that the comparatively long strap 30 passes through the loop 66, which is defined by the comparatively long strap 20 and by the comparatively short strap 60.

A preferred material for the straps 20, 30, 60, 70, is webbing made from NOMEX™ aramid fiber, which is available commercially from E. I. DuPont de Nemours and Company of Wilmington, Del. An alternative material for the straps 20, 30, 60, 70, is suitably tanned cowhide leather. A preferred material for the strap 40 and the similar straps is cotton-wrapped spandex, which has been treated so as to be flame-resistant.

As shown in FIG. 1, the pair 10 of suspenders conforms automatically to the shoulder-to-shoulder spacing of the wearer, with a wide range of shoulder-to-shoulder spacings including the comparatively narrow shoulder-to-shoulder shown in full lines and the comparatively wide shoulder-to-shoulder spacing shown in broken lines. It is not necessary to change a pivot, as disclosed in U.S. Pat. No. 4,850,057, for the pair 10 of suspenders to conform. Thus, the pair 10 of suspenders can be comfortably worn and does not unduly hamper the mobility of its wearer, whereby the pair 10 of suspenders can be advantageously worn by a firefighter, by a farmer, by a worker on an oil rig or on a building site, or by a person engaged in hunting or fishing.

Modifications may be made in the preferred and alternative embodiments, as shown and described, without departing from the scope and spirit of this invention. As an example, a pair of suspenders embodying this invention is adaptable for dress wear, rather than for heavy duty use.

What is claimed is:

1. A pair of suspenders, which comprises two comparatively long straps, each of which has a given width, wherein each of the comparatively long straps has a front portion terminating at a front end and a back portion terminating at a back end, wherein a comparatively short strap having two opposite ends is affixed at each of its opposite ends to the back portion of each of the comparatively long straps so as to define a loop, which has an overall length that is greater than the given width of the comparatively long straps, and wherein one of the comparatively long and comparatively short straps defining each of the loops crosses and passes through the other loop.

2. A pair of suspenders, which comprises two elongate straps, each of which has a given width, wherein each of the elongate straps has a front portion terminating at a front end and a back portion terminating at a back end, wherein each of the elongate straps has two layers at least at the back portion, wherein the two layers at the back portion of each of the elongate straps are separated from each other so as to define a loop, which has an overall length that is greater than the given width of the elongate straps, and wherein one of the separated layers defining each of the loops crosses and passes through the other loop.

3. The pair of suspenders of claim 1 or 2 wherein the straps are substantially inelastic.

4. The pair of suspenders of claim 3 wherein an elastic strap having an upper end and a lower end is attached at the upper end to each of the front portions of the straps having said portions, a fastener being attached to the lower end, the fastener being adapted for fastening to a pair of pants.

5. The pair of suspenders of claim 3 wherein an elastic strap having an upper end and a lower end is attached at the upper end to each of the back portions of the straps having said portions, a fastener being attached to the lower end, the fastener being adapted for fastening to a pair of pants.

6. The pair of suspenders of claim 3 wherein an elastic strap having an upper end and a lower end is attached at the upper end to each of the front and back portions of the straps having said portions, a fastener being attached to the lower end, the fastener being adapted for fastening to a pair of pants.

* * * * *

UNITED STATES PATENT AND TRADEMARK OFFICE

CERTIFICATE OF CORRECTION

PATENT NO. : 6,167,573 B1
DATED : January 2, 2001
INVENTOR(S) : Patricia Lewis

It is certified that error appears in the above-identified patent and that said Letters Patent is hereby corrected as shown below:

Abstract,
Line 16, between "to" and "each", "the" should be deleted.

Column 1,
Line 40, "No." should read --Re.--.

Column 2,
Line 59, "on" should read --one--.

Column 3,
Line 18, "As" should read --A--.
Line 21, between "via" and "similar", "s" should read --a--.
Line 45, "20, 30, 60, 60" should read --20,30,60,70--.

Signed and Sealed this

Fourteenth Day of August, 2001

*Attest:*

Nicholas P. Godici

NICHOLAS P. GODICI
*Acting Director of the United States Patent and Trademark Office*

*Attesting Officer*